US006088852A

United States Patent [19]

Quandt

[11] Patent Number: 6,088,852

[45] **Date of Patent: *Jul. 18, 2000**

[54] BED LINENS

[76] Inventor: Mary M. Quandt, 24 Summit Ave., Amsterdam, N.Y. 12010

[ * ] Notice: Under 35 U.S.C. 154(b), the term of this patent shall be extended for 351 days.

[21] Appl. No.: 08/562,816

[22] Filed: Nov. 27, 1995

[51] Int. Cl.[7] ..... A47G 9/00

[52] U.S. Cl. ..... 5/482; 5/486; 5/497; 5/502

[58] Field of Search ..... 5/482, 502, 497, 5/486, 413 R; 2/69.5

[56] References Cited

U.S. PATENT DOCUMENTS

| | | | |
|---|---|---|---|
| 831,733 | 9/1906 | Moore . | |
| 1,502,608 | 7/1924 | Young | 5/494 |
| 1,964,271 | 6/1934 | O'Dwyer | 5/494 |
| 2,449,758 | 9/1948 | Wikmark . | |
| 2,498,055 | 2/1950 | Veit . | |
| 2,525,713 | 10/1950 | North . | |
| 2,972,757 | 2/1961 | Adrian . | |
| 3,331,088 | 7/1967 | Marquette . | |
| 3,530,487 | 9/1970 | Bear | 5/496 |
| 4,014,055 | 3/1977 | Torres . | |
| 4,079,472 | 3/1978 | Maguire . | |
| 4,183,111 | 1/1980 | Zahavkochav | 5/413 R |
| 4,339,835 | 7/1982 | Jaffe et al. . | |
| 4,413,368 | 11/1983 | Schuetze | 5/413 R |
| 4,535,479 | 8/1985 | Pavla | 2/69.5 |
| 4,601,076 | 7/1986 | Knobeloch | 5/413 R |
| 4,680,821 | 7/1987 | Maguire . | |
| 4,924,543 | 5/1990 | Hoss et al. . | |
| 4,924,593 | 5/1990 | Hoss et al. | 5/502 |
| 5,023,969 | 6/1991 | Nattrass | 5/502 |

OTHER PUBLICATIONS

Journal of A.M.A. vol. 168 No. 7 (Gersman, Self Adhering, Nylon Tapes, Oct. 18, 1958).

*Primary Examiner*—Terry Lee Melius
*Assistant Examiner*—Fredrick Conley
*Attorney, Agent, or Firm*—Nixon & Vanderhye P.C.

[57] ABSTRACT

A bed linen is provided for positioning on a mattress that serves as a sheet, pillow cover, blanket and bedspread all at the same time. A bottom fabric sheet is provided that has a width much greater than that of a mattress on which it will be disposed so that it drapes over the sides of the mattress like a bedspread. A top fabric sheet is either connected to a central section of the width of the bottom sheet, the top fabric sheet having a width approximately equal (or less) to that of the mattress and connected to the bottom sheet by stitching along all of one side edge, the bottom edge, and the bottom half or more of the second side edge, and unconnected at the top; or the top sheet has a width substantially equal to that of the bottom sheet. A readily releasable connection, preferably a zipper, is provided between the top and bottom sheets to allow access to a sleeping volume between them. The faces of the top sheet and bottom sheet that are in face-to-face engagement are preferably of sweatshirt fleece (e.g. about 50% polyester/50% cotton). A pillow case is connected by snap fasteners adjacent the top edge of the bottom sheet and has a width much less than that of the bottom sheet.

19 Claims, 3 Drawing Sheets

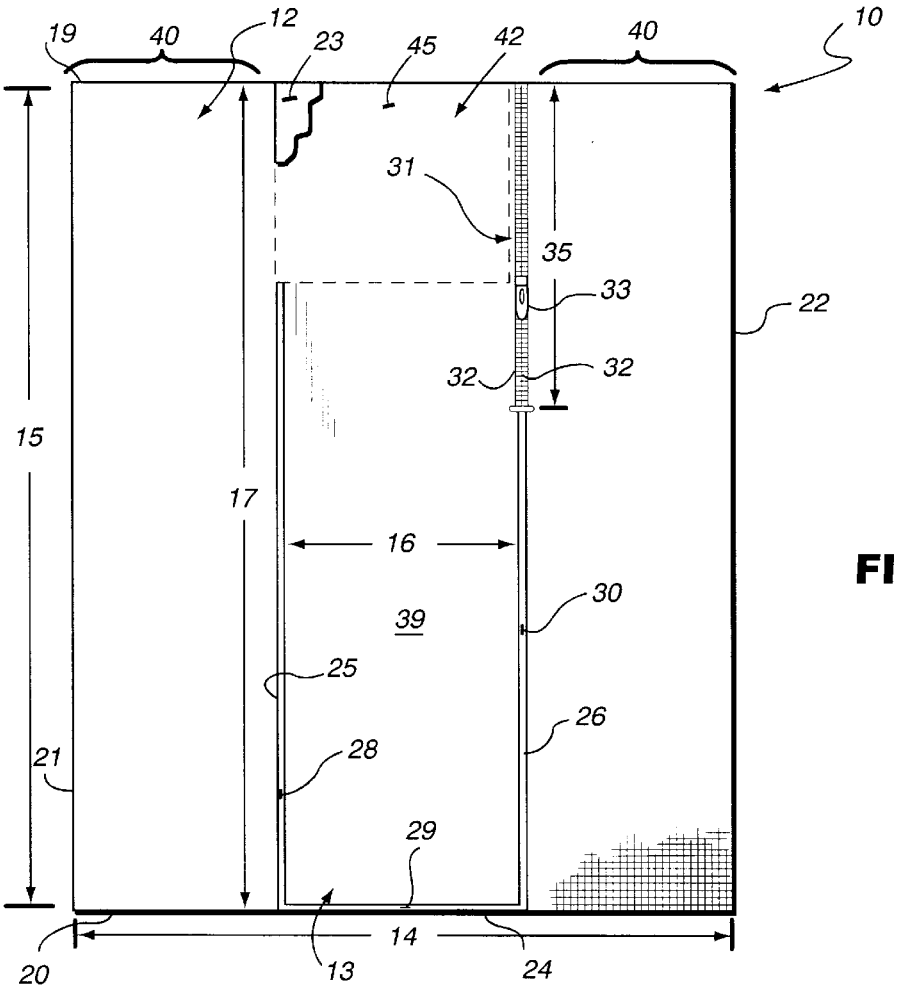
FIG. 1
FIG. 4
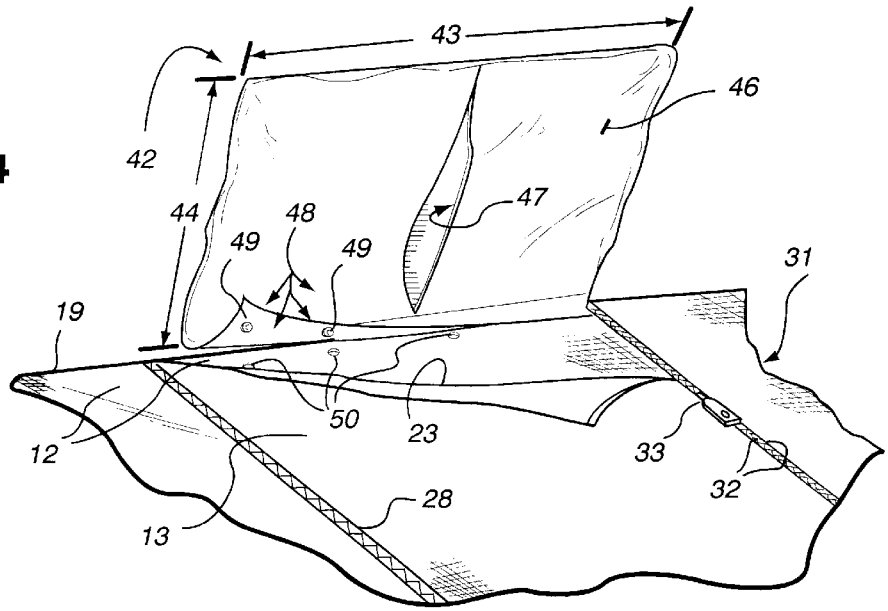

BED LINENS

BACKGROUND AND SUMMARY OF THE INVENTION

A nicely made bed is an important feature in the appearance of a bedroom. However many people cannot or will not properly make up their beds after use either due to laziness, physical problems, or lack of time in the morning. This is even more common for bunk beds, or for dormitory rooms, than for the average situation.

According to the present invention a bed linen is provided for positioning on a mattress or other sleeping device (such as a box spring, cot, or bed board) that literally takes seconds to "make up" with no skill or significant physical effort. The bed linen according to the present invention reduces the standard bed making process to the simplest level possible, and is particularly effective for traditionally more difficult bed elements, such as dormitory beds, bunk beds, couches and cots. The single bed linen according to the present invention serves as a sheet, pillow cover, blanket and bedspread all at the same time, providing comfort to the user when the user is asleep while providing an attractive appearance when simply made up with no tucking, bending, or assembling of separate layers of any kind. The bed linen according to the invention does not easly slip or move while in use, is comfortable during sleeping, and can be "made up" simply by zipping up a zipper only a few feet long and perhaps with one or two smoothing strokes with one's hand. The bed linen according to the invention may be removed from the bed element in one motion, such as by lifting it off a mattress, and may be washed as a single unit, typically in a standard size washing machine. The pillow cover may unsnapped, if desired, for laundering purposes, or increased freedom of movement of the pillow during sleep, or to provide different decorative elements for the bed linen by replacing the pillow case from time to time.

There are two basic embodiments of the invention. In one the top and bottom sheets are of substantially the same width; this embodiment provides a relatively large sleeping volume between the sheets and is simple to construct. In the second embodiment the top sheet is much narrow than the bottom sheet; this embodiment provides a more cozy sleeping volume, uses less material, and is easier to wash.

According to a first aspect of the present invention a bed linen for positioning on a mattress or other bed element having a first width is provided. The bed linen comprises the following components: A bottom fabric sheet having a second width at least about 50% greater than the first width, and a second length at least about 10% greater than the first length, and having a top, first and second sides, and bottom edges. A top fabric sheet having a third width substantially equal to or less than the first width and having a top, first and second sides, and bottom edges. A first connection between the top and bottom sheets along at least the first side edge of the top sheet, spaced from the first side edge of the bottom sheet. And a second, readily releasable, connection between the top and bottom sheets along at least part of the second side edge of the top sheet and spaced from the second side edge of the bottom sheet, extending from the top edge of the top sheet toward the bottom edge thereof. The top and bottom sheets are unconnected at the top edge of the top sheet.

The bed linen as described above further preferably comprises a pillow case having a fourth width substantially equal to or less than the third width and connected to the bottom sheet. Preferably the connection to the bottom sheet is by a readily releasable connection such as a plurality of conventional snap fasteners (e.g. each snap fastener comprising a male element and a female element).

The top sheet has a top face and a bottom face, and the bottom sheet has a bottom face and a top face having a first portion overlaid by the top sheet bottom face (the faces in face-to-face engagement), and second portions straddling the first portion. The top sheet bottom face and the bottom sheet top face first portion preferably are of conventional sweatshirt fleece, e.g. which can be made of about 50% polyester and about 50% cotton for providing a substantially wrinkle free appearance. The top face of the top sheet and the top face of the bottom sheet second portions are preferably of a non-fleece configuration, typically having the appearance of a conventional bedspread.

The second readily releasable connection preferably comprises a zipper which extends about one half the distance between the top sheet to edge toward the bottom sheet bottom edge, or less, e.g. extending about 36 inches. The first connection is typically provided between the top sheet and the bottom sheet bottom edges and is a substantially permanent connection, preferably comprising stitching such as in the form of a stitched hem.

According to a second aspect of the present invention, a bed linen for positioning on a mattress or other bed element having a first length and width, is provided, the bed linen comprising: a bottom fabric sheet having a second width greater than said first width, a second length greater than said first length, a top face and a bottom face, first and second side edges and top and bottom edges; a top fabric sheet having a third width, the third width being substantially the same as the second width, a top face and a bottom face, first and second side edges and top and bottom edges, a sleeping volume provided between the top sheet bottom face and the bottom sheet top face. And the top sheet connected to the bottom sheet adjacent the top sheet bottom and side edges, but said sheet substantially unconnected at the top edges, and the top sheet bottom face overlying the bottom sheet top face at at least a first portion of the bottom sheet top face. In this embodiment, the top sheet preferably has a zippered generally central access seam formed therein extending less than 50% the length of the bottom sheet, to allow access to the sleeping volume between the top and bottom sheets.

According to a third aspect of the present invention a bed linen for positioning on a mattress or other bed element having a first length and width is provided, comprising the following components: A bottom fabric sheet having a second width greater than the first width, a second length greater than the first length, a top face and a bottom face, first and second side edges and top and bottom edges. A top fabric sheet having a third width (which may be substantially the same as or less than the first width; or substantially the same as the second width), a top face and a bottom face, first and second side edges and top and bottom edges. The top sheet is connected to the bottom sheet adjacent the top sheet bottom and side edges, but the sheets are substantially unconnected at the top edges, and the top sheet bottom face overlying the bottom sheet top face at at least a first portion of the bottom sheet top face. And, wherein at least the bottom sheet top face first portion, and the top sheet bottom face, comprise sweatshirt fleece; and wherein the top sheet top face comprises a non-fleece surface. The details of the bed linen are preferably as described above for the first two embodiments. The sweatshirt fleece may cover the entire top sheet bottom face and the entire bottom sheet top face.

According to yet another aspect of the present invention a bed linen is provided comprising the following components: A bottom fabric sheet having a second width greater than the first width, a second length greater than the first length, a top face and a bottom face, first and second side edges and top and bottom edges. A top fabric sheet having a third width (either substantially the same as or less than the first width; or substantially the same as the second width), a top face and a bottom face, first and second side edges and top and bottom edges. And, a fabric pillow case having a fourth width substantially less than the second width, the pillow case connected to the bottom sheet by a plurality of conventional snap fasteners.

It is the primary object of the present invention to provide a single item serving as a sheet, pillow cover, blanket and bedspread which requires virtually no effort to "make up" yet provides an attractive appearance and comfort when used for sleeping. This and other objects invention will become clear from an inspection of the detailed description of the invention and from the appended claims.

BRIEF DESCRIPTION OF THE DRAWINGS

FIG. 1 is a top plan view of an exemplary bed linen according to the present invention;

FIG. 4 is a detail top perspective view showing the connection of the pillow cover to the bottom sheet.

DETAILED DESCRIPTION OF THE DRAWINGS

Figure 2:
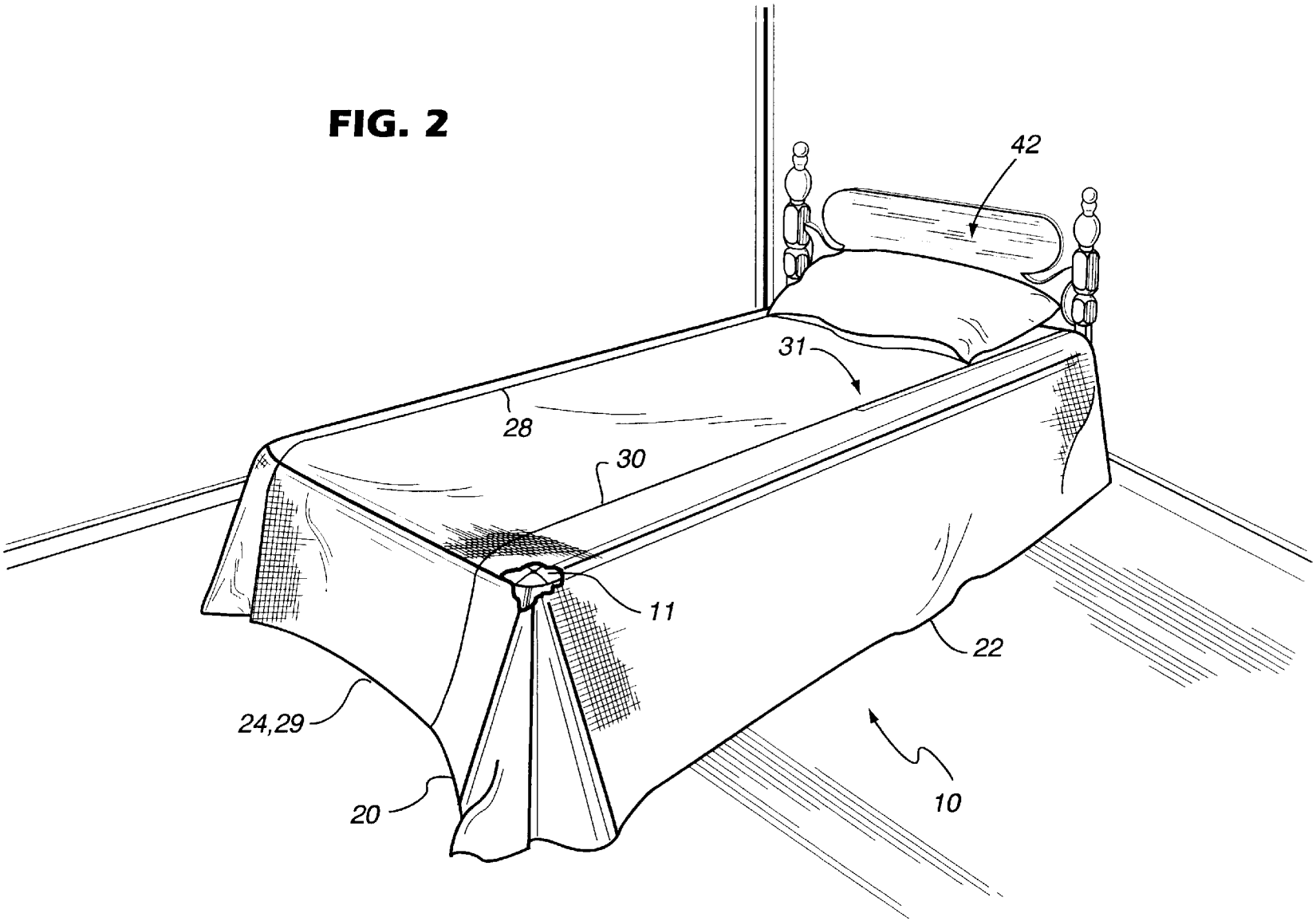
FIG. 2 is a top perspective view of the bed linen of FIG. 1 shown making up a twin bed.

An exemplary bed linen according to the present invention is shown generally by reference numeral 10 in FIGS. 1 and 2. The bed linen 10 is adapted to be positioned on a mattress 11 (see FIG. 2) or other bed element, such as a box spring, bed board, cot, hammock, or the like. As seen in all of FIGS. 1–4, in the preferred embodiment the bed linen includes a bottom fabric sheet 12 and a top fabric sheet 13. The bottom fabric sheet has a width 14 (see FIG. 1) and a length 15. The width 14 is typically at least about 50% greater than the width of the mattress 11 or other bed element with which the bed linen 10 is designed to be used (e.g. about 100% greater), and the length 15 is at least about 10% greater than the length of the mattress 10 or other bed element (e.g. about 30% greater), so that in use—as illustrated in FIG. 2—the bed linen 10 drapes over the mattress 11 at the sides and foot typically almost down to the floor, to provide the same general appearance as a bedspread.

While the width 14 and length 15 may vary widely, depending upon the particular bed elements with which they are used, for conventional dormitory size beds the width 14 is about 50–54 inches (e.g. about 52 inches) and the length 15 is about 80–90 inches (e.g. about 86 inches), whereas for a twin size mattress 11 the width 14 is about 71–75 inches (e.g. about 73 inches) and the length 15 approximately the same as for the dormitory size. While the bed linen 10 may be made larger, if it is larger then it will not fit in conventional home washing machines, whereas the twin size and dormitory sizes described above will.

The top fabric sheet 13 has a width 16 and a length 17. Typically the length 17 is approximately the same as that of the length 15 (although it may be slightly shorter), while the width 16 is approximately the width of the mattress 11 or other bed element, or less. For example the width 16 may be between about 20–40 inches.

The bottom sheet 12 has a top edge 19, adapted to be disposed adjacent the head of the bed with which it is used, a bottom edge 20 adapted to be disposed at the foot of the bed, a first side edge 21 and a second side edge 22. Preferably sheet 12 is quadrate in form, although the edges 20–22 may be scalloped or otherwise formed decoratively, including with fringe, tassels, or other decorative elements. The top sheet 13 likewise has a top edge 23 substantially in alignment with the edge 19, or spaced only slightly therefrom, a bottom edge 24 which typically is aligned with the bottom edge 20, and first and second side edges 25, 26.

The top sheet 13 is connected to the bottom sheet 12 so as to form an accessible comfortable sleeping enclosure. This is typically done by providing a connection 28 along substantially the entire first edge 25 of the top sheet 13, a connection 29 substantially along the entire bottom edge 24 of the top sheet 13, a connection 30 extending more than half of the length 17 of the top sheet 13 along the edge 26, and a separate connection 31 extending most of the rest of the length of the edge 26. The connections 28, 29, 30 typically are substantially permanent connections. While they may be formed by heat fusing the top and bottom sheets 13, 12 together (depending upon the materials of which they are made), or by mechanical fasteners or appropriate adhesives, in the preferred embodiment as illustrated in the drawings connections 28–30 are formed by stitching forming seams.

Figure 3:
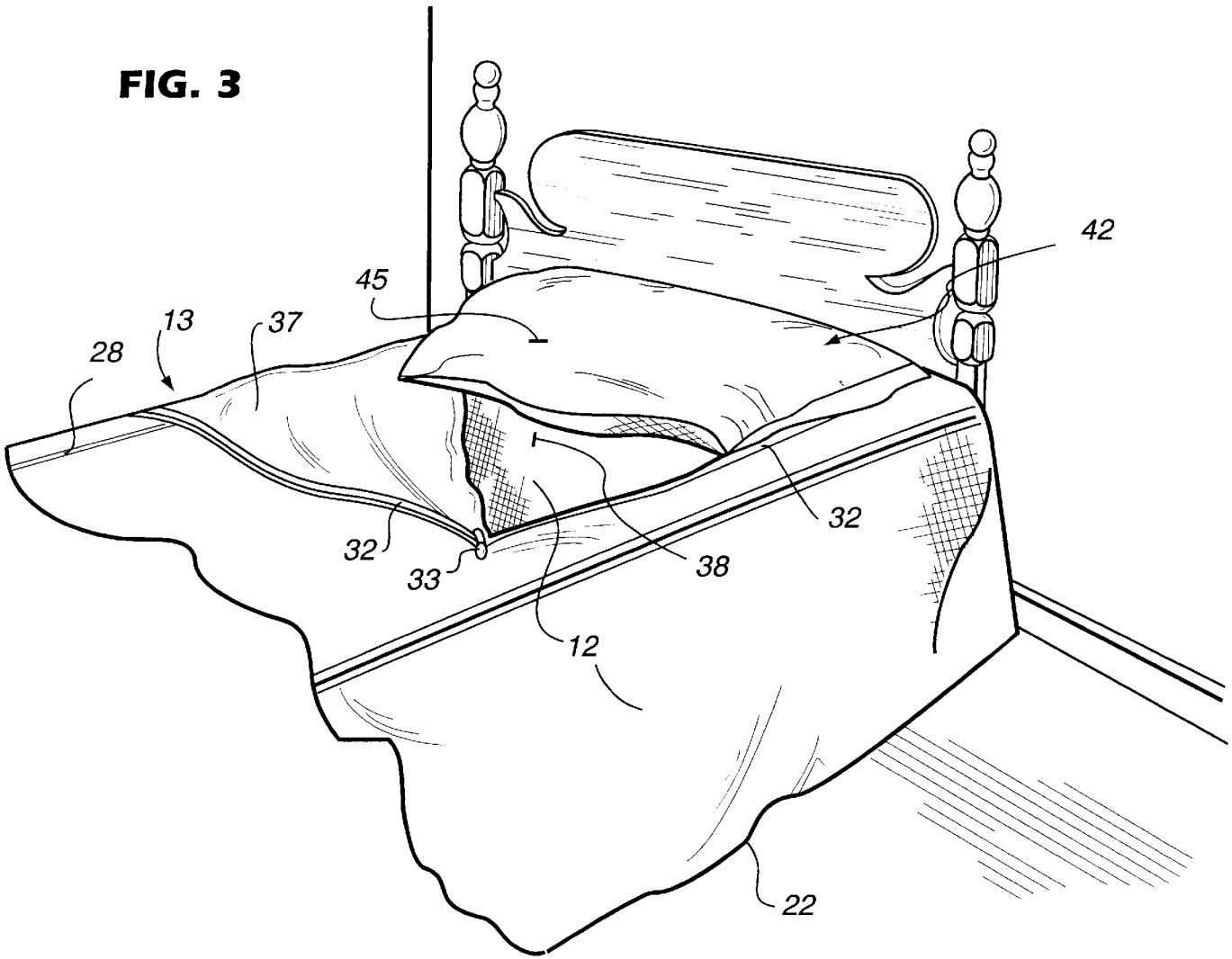
FIG. 3 is a detail view like that of FIG. 2 showing the top sheet unzipped along a side edge thereof, and the pillow cover flipped over covering the opening for entry into the sleeping area between the sheets.

The connection 31 preferably is a readily releasable connection, such as provided by cooperating hook and loop fastener strips (e.g. VELCRO), metal or plastic snap fasteners, or the like. Preferably the connection 31 is formed by a zipper. As illustrated in FIGS. 1, 3, and 4, the zipper 31 typically includes cooperating teeth 32, and a slide 33. Preferably the sheets 12, 13 are unconnected at the top.

Where the linen 10 is too large to effectively wash as one piece, the connections 28–31 may be provided by a plurality of hook and loop 25 fastener strips (one hook strip and one loop strip providing each of the connections 28, 29 and 30/31), and under some circumstances—such as where the bottom edges 20, 24 will drape a significant difference over the mattress 11 (as illustrated in FIG. 2)—the connection 29 may not be necessary. Also under some circumstances the length 17 need not be the same as the length 15, but rather the bottom edge 20 may be stitched or otherwise substantially permanently connected to the bottom sheet 12 spaced from the bottom edge 20 of the bottom sheet 12.

The length of the readily releasable connection 31 is long enough to allow ready access to a sleeping enclosure formed by the sheets 12, 13 where the sheet 13 overlays the sheet 12. For example as illustrated in FIGS. 1 and 3, the length 35 of the connection 31 is about 30–40 inches (e.g. about 36 inches), although it may extend substantially the entire length of edge 26 of the sheet 13.

While the fabric which makes up the sheets 12, 13 may be of a wide variety of types, and of almost any color or decoration, in the preferred embodiment thereof as illustrated in FIG. 3 the bottom face 37 of the top sheet 13 and the top face 38 of the bottom sheet 12, which are in face-to-face engagement with each other, preferably are formed by conventional sweatshirt fleece. For example the fleece may be formed by about 50% polyester/50% cotton so as to provide relatively wrinkle free characteristics to the bed linen 10. However in the preferred embodiment all of the rest of the components of the bed linen 10—such as the outer face 39 of the top sheet 13, or the outer faces of the side section 40 of the bottom sheet 12 straddling the top sheet 13—are of non-fleece material, but also may be, for example, of about 50% cotton/50% polyester. This construction may easily be provided by forming the bottom sheet 12 of three different panels which are stitched together along the hem 28–30, with the center panel of the bottom sheet 12 stitched to one of the side panels 40 along with the zipper tape of the zipper 31.

Another construction that may be provided according to the present invention—which has the same appearance as that illustrated in FIGS. 1–3—is to form the top and bottom sheets 12, 13 (in this case bottom sheet 12 would not be visible in FIGS. 1 and 2, and would only be visible in the exposed center section in FIGS. 3 and 4) of the same width and length, and connect them—preferably by stitching—along at least two (and preferably all three) of the edges 20–22. The seams 25, 30 would still normally be provided if the bed linen 10 were made out of sweatshirt fleece material since that material is not normally available in widths great enough to allow construction of the bed linen 10 out of a single sheet of material (for both the bottom and top), however the seams 25, 30 would only be in the top sheet 13—and separately in the bottom sheet 12—not connecting the two sheets 12, 13 together. In this case the fleece portions 37, 38 of both the top and bottom sheets 12, 13 would face inwardly toward the sleeping compartment or volume between the sheets, and accessible as illustrated in FIG. 3 by undoing the zipper 32. The zipper 32 in this embodiment comprises a readily openable generally central access seam formed in the top sheet 13 extending less than 50% the length of said bottom sheet, to allow access to the volume between said top and bottom sheets for sleeping. This embodiment is typically easier to construct, and provides a more wide open sleeping compartment, but is more difficult to wash and uses more material than the earlier described embodiment.

In the preferred construction—for both embodiments as described above—a pillow case 42 (seen in all of the drawings) is also provided, the pillow case 42 typically having a width 43 (see FIG. 4) which is substantially equal to or slightly less than the width 16, and wide enough to contain the length of a standard pillow. The pillowcase 42 also has a length 44—see FIG. 4—long enough to accommodate the width of the conventional pillow. The top face 45 of the pillowcase 42—seen in FIGS. 1 through 3—is typically continuous, while the bottom face 46—see FIG. 4—is formed by overlapping cloth portions which have an access opening 47 formed therebetween to allow insertion of and removal of a pillow, such a conventional foam or feather pillow.

Also in the preferred embodiment the pillow case 42 is connected to the bottom sheet 12, preferably by a readily releasable connection. While the readily releasable connection may comprise one or more hook strips cooperating with one or more loop strips (e.g.

VELCRO strips), for maximum comfort typically the readily releasable connection is formed by a plurality of plastic or metal snap fasteners, shown generally by reference numeral 48 in FIG. 4. For example a plurality of conventional male snap fasteners 49 are attached (by stitching, adhesive, etc.) to a flap 50 formed at an edge of the pillow case 42, while a plurality of conventional female snap fasteners 50 are adhesively, by stitching, or the like secured to the bottom sheet 12 adjacent the top edge 19 thereof at the center portion thereof which will be overlaid by the top sheet 13. In this way while the pillow case 42 may be readily detached during sleeping for added comfort for some sleepers, or for washing, it will be positively and easily positioned when the bed is "made up" as illustrated in FIG. 2.

It will thus be seen that according to the present invention a bed linen 10 is provided which is the epitome of simplicity. A very comfortable sleeping enclosure is provided which is accessible by a user zipping down the zipper 31 by pulling the slide 33 towards the foot of the bed to the position illustrated in FIG. 3, crawling into the volume between the overlaid top and bottom sheets 13, 12 into contact with the fleece faces 37, 38 and optionally zipping the zipper 31 at least partially back up. The pillow in the pillow case 42 is readily detached by pulling apart the fasteners 49, 50. In the morning normally the fasteners 49, 50 are reconnected (although they may be left unconnected if desired), the user crawls out between the sheets 13, 12, and zips the zipper 31 up by pulling the slide 33 toward the top edges 19, 23, providing—with perhaps a few strokes one's hand to smooth out any wrinkles—a completely made up bed as illustrated in FIG. 2. The bed linen 10 will typically not have the tendency to shift along the mattress during use, and that may be facilitated by forming the bottom face of the sheet 12 of a material which has high friction properties. However, even in the event that the bed linen 10 becomes partially displaced it may easily be centered on the mattress 11 or the like with even greater simplicity than a conventional bedspread would be centered, and without having to make the bed with conventional cloth bed sheets.

It will thus be seen that according to the present invention an advantageous bed linen has been provided which is the ultimate of simplicity in making up a bed, particularly dormitory type beds, twin beds, bunk beds, cots, and the like, yet provides a comfortable sleeping environment/enclosure, including with self attached pillow. While the invention has been herein shown and described in what is presently conceived to be the most practical and preferred embodiment thereof it will be apparent to those of ordinary skill in the art that many modifications may be made thereof within the scope of the invention, which scope is to be accorded the broadest interpretation of the appended claims so as to encompass all equivalent structures and devices.

What is claimed is:

1. A bed linen positioned on a mattress, box spring, bed board, cot, or hammock having a first width and first length, said bed linen comprising:

a bottom fabric sheet having a second width at least about 50% greater than said first width, and a second length at least about 10% greater than said first length, and having a top, first and second side, and bottom edges, said bottom fabric sheet positioned on said mattress, box spring, bed board, cot, or hammock;

a top fabric sheet having a third width less than said first width and having a top, first and second side, and bottom edges;

a first connection between said top and bottom sheets along substantially the entire length of said first side edge of said top sheet, spaced from said first side edge of said bottom sheet;

a second, readily releasable, connection between said top and bottom sheets along at least part of said second side edge of said top sheet, and spaced from said second side edge of said bottom sheet, extending from said top edge of said top sheet toward said bottom edge thereof; and said top and bottom sheets unconnected at said top edge of said top sheet.

2. A bed linen and mattress, box spring, bed board, cot, or hammock combination as recited in claim 1 further comprising a pillow case having a fourth width substantially equal to or less than said third width and connected to said bottom sheet.

3. A bed linen and mattress, box spring, bed board, cot, or hammock combination as recited in claim 2 wherein said pillow case is connected to said bottom sheet by a readily releasable connection.

4. A bed linen and mattress, box spring, bed board, cot, or hammock combination as recited in claim 3 wherein said releasable connection between said bottom sheet and said pillow case comprises a plurality of linearly aligned, spaced snap fasteners, each said snap fastener comprises a male element and a female element.

5. A bed linen and mattress, box spring, bed board, cot, or hammock combination as recited in claim 1 wherein said first connection is a substantially permanent connection, and extends from said bottom edge of said top sheet along said first side edge of said top sheet, from said bottom edge of said top sheet toward said second connection, and along said bottom edge of said bottom sheet.

6. A bed linen and mattress, box spring, bed board, cot, or hammock combination as recited in claim 1 wherein said top sheet has a top face and a bottom face and said bottom sheet comprises a bottom face and a top face having a first portion overlaid by said top sheet bottom face, and second portions straddling said first portion; and wherein said top sheet bottom face and said bottom sheet top face first portion comprise sweatshirt fleece.

7. A bed linen and mattress, box spring, bed board, cot, or hammock combination as recited in claim 5 wherein said first connection comprises a stitched hem.

8. A bed linen and mattress, box spring, bed board, cot, or hammock combination as recited in claim 1 wherein said second readily releasable connection comprises a zipper which extends about one half, or less, the distance between said top sheet top edge toward said bottom sheet bottom edge.

9. A bed linen and mattress, box spring, bed board, cot, or hammock combination as recited in claim 5 wherein said first connection is also provided between said top sheet and bottom sheet bottom edges; and wherein said top sheet has a top face and a bottom face and said bottom sheet comprises a bottom face and a top face having a first portion overlaid by said top sheet bottom face, and second portions straddling said first portion; and wherein said top sheet bottom face and said bottom sheet top face first portion comprise sweatshirt fleece of roughly 50/50 polyester/cotton.

10. A bed linen and mattress, box spring, bed board, cot, or hammock combination as recited in claim 1 further comprising a pillow case having a fourth width substantially equal to said third width.

11. A bed linen for positioning on a mattress, box spring, bed board, cot, or hammock, said bed linen comprising:

a bottom fabric sheet having a width of about 50–75 inches, a length of about 80–90 inches, a top face and a bottom face, first and second side edges and top and bottom edges;

a top fabric sheet having a width and length substantially the same as said bottom fabric sheet, a top face and a bottom face, first and second side edges and top and bottom edges, a sleeping volume provided between said top sheet bottom face and said bottom sheet top face;

said top sheet connected to said bottom sheet adjacent said top sheet bottom and side edges, but said top and bottom sheets substantially unconnected at said top edges, and said top sheet bottom face overlying said bottom sheet top face along substantially the entire length and width of both said top and bottom sheets; and wherein said top sheet has a zippered generally central access seam formed therein extending less than 50% the length of said bottom sheet, to allow access to the sleeping volume between said top and bottom sheets.

12. A bed linen for positioning on a mattress, box spring, bed board, cot, or hammock, said bed linen comprising:

a bottom fabric sheet having a width, a top face and a bottom face, first and second side edges a length of about 80–90 inches and top and bottom edges;

a top fabric sheet having a width, a top face and a bottom face, first and second side edges and top and bottom edges;

said top sheet connected to said bottom sheet adjacent said top sheet bottom and side edges, but said sheet substantially unconnected at said top edges, and said top sheet bottom face overlying said bottom sheet top face; and wherein at least said bottom sheet top face, and said top sheet bottom face, comprise sweatshirt fleece; and wherein said top sheet top face comprises a non-fleece surface.

13. A bed linen as recited in claim 12 wherein said top and bottom sheets have widths that are substantially the same as each other, a sleeping volume provided between said top and bottom sheets.

14. A bed linen as recited in claim 13 wherein said top sheet has a readily openable generally central access seam formed therein extending less than 50% the length of said bottom sheet, to allow access to the volume between said top and bottom sheets for sleeping.

15. A bed linen as recited in claim 12 and further comprising a fabric pillow case having a width less than half the width of said bottom sheet, said pillow case connected to said bottom sheet by a plurality of spaced in line snap fasteners.

16. A bed linen as recited in claim 12 wherein said bottom sheet has a width of between about 50–75 inches and wherein said top sheet has a width of about 20–40 inches.

17. A bed linen for positioning on a mattress, box spring, bed board, cot, or hammock, said bed linen comprising:

a bottom fabric sheet having a width, a top face and a bottom face, first and second side edges and top and bottom edges;

a top fabric sheet having a top face and a bottom face, first and second side edges, and top and bottom edges;

said top fabric sheet overlying and connected to said bottom fabric sheet to define a sleeping volume between said top and bottom sheets; and a fabric pillow case having a bottom fabric sheet to define width less than half the width of said bottom fabric sheet, said pillow case connected to said bottom fabric sheet by a plurality of spaced, in line snap fasteners.

18. A bed linen as recited in claim 17 wherein said top sheet is connected to said bottom sheet along at least said second side edge and bottom edge of said top sheet by stitching.

19. A bed linen as recited in claim 18 wherein in said sleeping volume said top sheet bottom face and said bottom sheet top face comprise sweatshirt fleece.

* * * * *